US009721530B2

(12) United States Patent
Han et al.

(10) Patent No.: US 9,721,530 B2
(45) Date of Patent: Aug. 1, 2017

(54) METHOD OF DISPLAYING AN IMAGE, DISPLAY APPARATUS PERFORMING THE SAME, METHOD OF CALCULATING A CORRECTION VALUE APPLIED TO THE SAME AND METHOD OF CORRECTING GRAYSCALE DATA

(71) Applicant: Samsung Display Co., Ltd., Yongin, Gyeonggi-Do (KR)

(72) Inventors: Jung-Suk Han, Hwaseong-si (KR); Hoi-Sik Moon, Asan-si (KR); Kang-Hyun Kim, Seoul (KR); Jong-Hee Na, Asan-si (KR); Jun-Il Park, Cheonan-si (KR); Woo-Jin Jung, Seoul (KR); Jae-Seob Chung, Asan-si (KR)

(73) Assignee: Samsung Display Co., Ltd., Samsung-ro, Giheung-Gu, Yongin-si, Gyeonggi-Do (KR)

( * ) Notice: Subject to any disclaimer, the term of this patent is extended or adjusted under 35 U.S.C. 154(b) by 152 days.

(21) Appl. No.: 14/606,603

(22) Filed: Jan. 27, 2015

(65) Prior Publication Data

US 2016/0019865 A1 Jan. 21, 2016

(30) Foreign Application Priority Data

Jul. 21, 2014 (KR) ..... 10-2014-0092016

(51) Int. Cl.

| | |
|---|---|
| ***G09G 5/02*** | (2006.01) |
| ***G09G 3/36*** | (2006.01) |
| *G09G 5/18* | (2006.01) |

(52) U.S. Cl.

CPC ..... *G09G 5/02* (2013.01); *G09G 3/3648* (2013.01); *G09G 5/18* (2013.01); *G09G 2320/0666* (2013.01); *G09G 2320/0673* (2013.01); *G09G 2360/145* (2013.01); *G09G 2370/08* (2013.01)

(58) Field of Classification Search

CPC ... G09G 2320/0673; G09G 2320/0276; G09G 2330/028; G09G 2320/0242; G09G 2320/0233

See application file for complete search history.

(56) References Cited

U.S. PATENT DOCUMENTS

2008/0252797 A1* 10/2008 Hamer ..... G09G 3/3208 348/802

2011/0012908 A1 1/2011 Daly (Continued)

FOREIGN PATENT DOCUMENTS

JP 2009-151042 A 7/2009

KR 10-2005-0119452 A 12/2005

(Continued)

*Primary Examiner* — Gerald Johnson

(74) *Attorney, Agent, or Firm* — Robert E. Buschnell, Esq.

(57) ABSTRACT

A method of displaying an image on a display panel which comprises a plurality of pixels arranged as a matrix type includes measuring a tristimulus value of X, Y and Z values of a displayed image to generate a target curve, generating a corrected grayscale data of a red pixel, a green pixel and a blue pixel using X, Y and Z values of the target curve and converting the corrected grayscale data to a data voltage to provide a data line of the display panel with the data voltage.

12 Claims, 5 Drawing Sheets

(56) References Cited

U.S. PATENT DOCUMENTS

| | | | | |
|---|---|---|---|---|
| 2011/0234644 | A1* | 9/2011 | Park | G09G 3/2003 345/690 |
| 2012/0075354 | A1 | 3/2012 | Su et al. | |
| 2014/0055481 | A1* | 2/2014 | Gao | G09G 5/02 345/589 |

FOREIGN PATENT DOCUMENTS

| | | | |
|---|---|---|---|
| KR | 10-2007-0041942 | A | 4/2007 |
| KR | 10-2012-0092982 | A | 8/2012 |
| KR | 10-2013-0090211 | A | 8/2013 |
| KR | 10-2014-0093011 | A | 7/2014 |
| KR | 1020150030013 | A | 3/2015 |

* cited by examiner

METHOD OF DISPLAYING AN IMAGE, DISPLAY APPARATUS PERFORMING THE SAME, METHOD OF CALCULATING A CORRECTION VALUE APPLIED TO THE SAME AND METHOD OF CORRECTING GRAYSCALE DATA

CLAIM OF PRIORITY

This application makes reference to, incorporates the same herein, and claims all benefits accruing under 35 U.S.C §119 from an application earlier filed in the Korean Industrial Property Office on 21 Jul. 2014, and there duly assigned Serial No. 10-2014-0092016 by that Office.

BACKGROUND OF THE INVENTION

Field of the Invention

The present inventive concept relates to a method of displaying an image, a display apparatus for performing the method of displaying the image, a method of calculating a correction value applied to the method and the display apparatus and a method of correcting grayscale data. More particularly, the present inventive concept relates to a method of displaying an image capable of improving a stain of a display panel, a display apparatus for performing the method of displaying the image, a method of calculating a correction value applied to the method and the display apparatus and a method of correcting grayscale data.

Description of the Related Art

In general, a liquid crystal (LC) display panel includes a lower substrate, an upper substrate opposite to the lower substrate and an LC layer disposed between the lower substrate and the lower substrate. The lower substrate includes a pixel area defining a pixel and a peripheral area receiving a driving signal which is applied to the pixel.

A data line, a gate line and a pixel electrode are disposed in the pixel area. The data line extends in a first direction, the gate line extends in a second direction crossing the first direction and the pixel electrode is connected to the data line and the gate line. A first driving chip pad and a second driving chip pad are disposed in the peripheral area. The first driving chip pad receives a data signal and the second driving chip pad receives a gate signal.

After the LC layer is disposed between the lower substrate and the lower substrate, the LC panel is tested through a visual test process which tests electrical and optical operations of the LC panel. In general, the visual test process tests include testing various pattern stains by using a tester's eyes and removing the various pattern stains using a stain remover algorithm reflecting a tested result using the tester's eyes. As described above, the various pattern stains are manually tested by the tester, which increases a test process period is increased and an identification differences of the testers. Thus, productivity may be decreased and compensation error may be increased.

In addition, since the removing the various pattern stains uses difference of luminance, stains due to colors may be not removed.

SUMMARY OF THE INVENTION

Exemplary embodiments of the present inventive concept provide a method of displaying an image capable of improving a stain of a display panel.

Exemplary embodiments of the present inventive concept further provide a display apparatus for performing the method of displaying the image.

Exemplary embodiments of the present inventive concept further provide a method of calculating a correction value applied to the method and the display apparatus.

Exemplary embodiments of the present inventive concept further provide a method of correcting grayscale data applied to the method and the display apparatus.

In an exemplary embodiment of a method of displaying an image on a display panel which comprises a plurality of pixels arranged as a matrix type according to the present inventive concept, the method includes measuring a tristimulus value of X, Y and Z values of a displayed image to generate a target curve, generating a corrected grayscale data of a red pixel, a green pixel and a blue pixel using X, Y and Z values of the target curve and converting the corrected grayscale data to a data voltage to provide a data line of the display panel with the data voltage.

In an exemplary embodiment, the corrected grayscale data may include calculating target grayscale values of red pixel, green pixel and blue pixel using X, Y and Z values of the target curve, calculating a variation of a red pixel, a green pixel and a blue pixel using target grayscale values of a red pixel, a green pixel and a blue pixel and applying the variation of a red pixel, a green pixel and a blue pixel to a grayscale value corresponding to the displayed image to generate a corrected grayscale data.

In an exemplary embodiment, the target grayscale values of a red pixel, a green pixel and a blue pixel may be defined by the following Equations:

$$\mathrm{Red}_{Target\ Gray} = \mathrm{Max\ Gray} \times G_{Red\ target}^{\frac{1}{Red\ Gamma}}$$

$$\mathrm{Green}_{Target\ Gray} = \mathrm{Max\ Gray} \times G_{Green\ target}^{\frac{1}{Green\ Gamma}}$$

$$\mathrm{Blue}_{Target\ Gray} = \mathrm{Max\ Gray} \times G_{Blue\ target}^{\frac{1}{Blue\ Gamma}}.$$

The $\mathrm{Red}_{Target\ Gray}$ may be a red target grayscale value. The $\mathrm{Green}_{Target\ Gray}$ may be a green target grayscale value. The $\mathrm{Blue}_{Target\ Gray}$ may be a blue target grayscale value. The MaxGray may be a maximum grayscale value in a pixel. The $G_{Redtarget}$, the $G_{Greentarget}$ and the $G_{Bluetarget}$ may be defined by the following Equation:

$$\begin{pmatrix} G_{Red\ target} \\ G_{Green\ target} \\ G_{Blue\ target} \end{pmatrix} = \begin{pmatrix} X_{Red\ Max\ Gray-1} & X_{Green\ Max\ Gray-1} & X_{Blue\ Max\ Gray-1} \\ Y_{Red\ Max\ Gray-1} & Y_{Green\ Max\ Gray-1} & Y_{Blue\ Max\ Gray-1} \\ Z_{Red\ Max\ Gray-1} & Z_{Green\ Max\ Gray-1} & Z_{Blue\ Max\ Gray-1} \end{pmatrix}^{-1} \begin{pmatrix} X_{target} \\ Y_{target} \\ Z_{target} \end{pmatrix}$$

The $X_{target}$, the $Y_{target}$ and the $Z_{target}$ may be X, Y and Z values of the target curve respectively. The Red Gamma, the Green Gamma and the Blue Gamma may be defined by the following Equations:

$$\text{Red Gamma} = \frac{\log\left(\frac{Y_{Red}}{Y_{Red\ Max\ Gray}}\right)}{\log\left(\frac{\mathrm{Red}_{Gray}}{\mathrm{Max\ Gray}}\right)}$$

-continued $$\text{Green Gamma} = \frac{\log\left(\frac{Y_{Green}}{Y_{Green\ Max\ Gray}}\right)}{\log\left(\frac{\text{Green}_{Gray}}{\text{Max Gray}}\right)}$$

$$\text{Blue Gamma} = \frac{\log\left(\frac{Y_{Blue}}{Y_{Blue\ Max\ Gray}}\right)}{\log\left(\frac{\text{Blue}_{Gray}}{\text{Max Gray}}\right)}.$$

The $Y_{Red\ Max\ Gray}$ may be a Y value emitted at a MaxGray of a red pixel. The $Y_{Green\ Max\ Gray}$ may be a Y value emitted at a MaxGray of a green pixel. The $Y_{Blue\ Max\ Gray}$ may be a Y value emitted at a MaxGray of a blue pixel. The $Y_{Red}$, the $Y_{Green}$ and the $Y_{Blue}$ may be Y values at a red pixel, a green pixel and a blue pixel of the displayed image respectively. The $\text{Red}_{Gray}$, the $\text{Green}_{Gray}$ and the $\text{Blue}_{Gray}$ may be grayscale values at a red pixel, a green pixel and a blue pixel of the displayed image respectively.

In an exemplary embodiment, the $X_{RedMaxGray\text{-}1}$, the $Y_{RedMaxGray\text{-}1}$ and the $Z_{RedMaxGray\text{-}1}$ may have the same values as the $X_{RedMaxGray}$, the $Y_{RedMaxGray}$ and the $Z_{RedMaxGray}$ respectively. The $X_{GreenMaxGray\text{-}1}$, the $Y_{GreenMaxGray\text{-}1}$ and the $Z_{GreenMaxGray\text{-}1}$ may have the same values as the $X_{GreenMaxGray}$, the $Y_{GreenMaxGray}$ and the $Z_{GreenMaxGray}$ respectively. The $X_{BlueMaxGray\text{-}1}$, the $Y_{BlueMaxGray\text{-}1}$ and the $Z_{BlueMaxGray\text{-}1}$ may have the same values as the $X_{BlueMaxGray}$, the $Y_{BlueMaxGray}$ and the $Z_{BlueMaxGray}$ respectively.

In an exemplary embodiment, a ratio of X:Y:Z of measured value of the displayed image may be equal to a ratio of X:Y:Z of the red pixel, the green pixel and the blue pixel.

In an exemplary embodiment of a display apparatus according to the present inventive concept, the display apparatus includes a display panel which comprises a plurality of pixels arranged as a matrix type, a storage part configured to store a grayscale correction value of a reference pixel respectively corresponding to a plurality of sample grayscales, the reference pixel comprising to m×n pixels ('m' and 'n' are a natural number), a data correction part configured to generate corrected grayscale data utilizing a grayscale correction value of the reference pixel and a data driving part configured to generate data voltages based on the corrected grayscale data and to provide the data lines with the data voltages.

In an exemplary embodiment, the data correction part may be configured to measure a tristimulus value of X, Y and Z values of a displayed image, configured to generate a target curve with respect to the tristimulus value of X, Y and Z values of a displayed image, configured to calculate target grayscale values of red pixel, green pixel and blue pixel using X, Y and Z values of the target curve, configured to calculate a variation of a red pixel, a green pixel and a blue pixel using target grayscale values of a red pixel, a green pixel and a blue pixel and configured to apply the variation of a red pixel, a green pixel and a blue pixel to a grayscale value corresponding to the displayed image to generate a corrected grayscale data.

In an exemplary embodiment, the target grayscale values of a red pixel, a green pixel and a blue pixel may be defined by the following Equations:

$$\text{Red}_{Target\ Gray} = \text{Max Gray} \times G_{Red\ target}^{\frac{1}{Red\ Gamma}}$$

-continued $$\text{Green}_{Target\ Gray} = \text{Max Gray} \times G_{Green\ target}^{\frac{1}{Green\ Gamma}}$$

$$\text{Blue}_{Target\ Gray} = \text{Max Gray} \times G_{Blue\ target}^{\frac{1}{Blue\ Gamma}}.$$

The $\text{Red}_{Target\ Gray}$ may be a red target grayscale value. The $\text{Green}_{Target\ Gray}$ may be a green target grayscale value. The $\text{Blue}_{Target\ Gray}$ may be a blue target grayscale value. The MaxGray may be a maximum grayscale value in a pixel. The $G_{Redtarget}$, the $G_{Greentarget}$ and the $G_{Bluetarget}$ may be defined by the following Equation:

$$\begin{pmatrix} G_{Red\ target} \\ G_{Green\ target} \\ G_{Bluetarget} \end{pmatrix} = \begin{pmatrix} X_{Red\ Max\ Gray-1} & X_{Green\ Max\ Gray-1} & X_{Blue\ Max\ Gray-1} \\ Y_{Red\ Max\ Gray-1} & Y_{Green\ Max\ Gray-1} & Y_{Blue\ Max\ Gray-1} \\ Z_{Red\ Max\ Gray-1} & Z_{Green\ Max\ Gray-1} & Y_{Blue\ Max\ Gray-1} \end{pmatrix}^{-1} \begin{pmatrix} X_{target} \\ Y_{target} \\ Z_{target} \end{pmatrix}$$

The $X_{target}$, the $Y_{target}$ and the $Z_{target}$ may be X, Y and Z values of the target curve respectively. The Red Gamma, the Green Gamma and the Blue Gamma may be defined by the following Equations:

$$\text{Red Gamma} = \frac{\log\left(\frac{Y_{Red}}{Y_{Red\ Max\ Gray}}\right)}{\log\left(\frac{\text{Red}_{Gray}}{\text{Max Gray}}\right)}$$

$$\text{Green Gamma} = \frac{\log\left(\frac{Y_{Green}}{Y_{GreenMax\ Gray}}\right)}{\log\left(\frac{\text{Green}_{Gray}}{\text{Max Gray}}\right)}$$

$$\text{Blue Gamma} = \frac{\log\left(\frac{Y_{Blue}}{Y_{BlueMax\ Gray}}\right)}{\log\left(\frac{\text{Blue}_{Gray}}{\text{Max Gray}}\right)}.$$

The $Y_{Red\ Max\ Gray}$ may be a Y value emitted at a MaxGray of a red pixel. The $Y_{Green\ Max\ Gray}$ may be a Y value emitted at a MaxGray of a green pixel. The $Y_{Blue\ Max\ Gray}$ may be a Y value emitted at a MaxGray of a blue pixel. The $Y_{Red}$, the $Y_{Green}$ and the $Y_{Blue}$ may be Y values at a red pixel, a green pixel and a blue pixel of the displayed image respectively. The $\text{Red}_{Gray}$, the $\text{Green}_{Gray}$ and the $\text{Blue}_{Gray}$ may be grayscale values at a red pixel, a green pixel and a blue pixel of the displayed image respectively.

In an exemplary embodiment, the $X_{RedMaxGray\text{-}1}$, the $Y_{RedMaxGray\text{-}1}$ and the $Z_{RedMaxGray\text{-}1}$ may have the same values as the $X_{RedMaxGray}$, the $Y_{RedMaxGray}$ and the $Z_{RedMaxGray}$ respectively. The $X_{GreenMaxGray\text{-}1}$, the $Y_{GreenMaxGray\text{-}1}$ and the $Z_{GreenMaxGray\text{-}1}$ may have the same values as the $X_{GreenMaxGray}$, the $Y_{GreenMaxGray}$ and the $Z_{GreenMaxGray}$ respectively. The $X_{BlueMaxGray\text{-}1}$, the $Y_{BlueMaxGray\text{-}1}$ and the $Z_{BlueMaxGray\text{-}1}$ may have the same values as the $X_{BlueMaxGray}$, the $Y_{BlueMaxGray}$ and the $Z_{BlueMaxGray}$ respectively.

In an exemplary embodiment, a ratio of X:Y:Z of measured value of the displayed image may be equal to a ratio of X:Y:Z of the red pixel, the green pixel and the blue pixel.

In an exemplary embodiment of method of calculating a correction value according to the present inventive concept, the method includes measuring a tristimulus value of X, Y and Z values of a displayed image, generating a target curve with respect to the tristimulus value of X, Y and Z values of a displayed image, calculating target grayscale values of red pixel, green pixel and blue pixel using X, Y and Z values of the target curve and calculating a variation of a red pixel, a green pixel and a blue pixel using target grayscale values of a red pixel, a green pixel and a blue pixel.

In an exemplary embodiment, the target grayscale values of a red pixel, a green pixel and a blue pixel may be defined by the following Equations:

$$\mathrm{Red}_{Target\ Gray} = \mathrm{Max\ Gray} \times G_{Red\ target}^{\frac{1}{Red\ Gamma}}$$

$$\mathrm{Green}_{Target\ Gray} = \mathrm{Max\ Gray} \times G_{Green\ target}^{\frac{1}{Green\ Gamma}}$$

$$\mathrm{Blue}_{Target\ Gray} = \mathrm{Max\ Gray} \times G_{Blue\ target}^{\frac{1}{Blue\ Gamma}}.$$

The $\mathrm{Red}_{Target\ Gray}$ may be a red target grayscale value. The $\mathrm{Green}_{Target\ Gray}$ may be a green target grayscale value. The $\mathrm{Blue}_{Target\ Gray}$ may be a blue target grayscale value. The MaxGray may be a maximum grayscale value in a pixel. The $G_{Redtarget}$, the $G_{Greentarget}$ and the $G_{Bluetarget}$ may be defined by the following Equation:

$$\begin{pmatrix} G_{Red\ target} \\ G_{Green\ target} \\ G_{Bluetarget} \end{pmatrix} = \begin{pmatrix} X_{Red\ Max\ Gray-1} & X_{Green\ Max\ Gray-1} & X_{Blue\ Max\ Gray-1} \\ Y_{Red\ Max\ Gray-1} & Y_{Green\ Max\ Gray-1} & Y_{Blue\ Max\ Gray-1} \\ Z_{Red\ Max\ Gray-1} & Z_{Green\ Max\ Gray-1} & Y_{Blue\ Max\ Gray-1} \end{pmatrix}^{-1} \begin{pmatrix} X_{target} \\ Y_{target} \\ Z_{target} \end{pmatrix}.$$

The $X_{target}$, the $Y_{target}$ and the $Z_{target}$ may be X, Y and Z values of the target curve respectively. The Red Gamma, the Green Gamma and the Blue Gamma may be defined by the following Equations:

$$\mathrm{Red\ Gamma} = \frac{\log\left(\frac{Y_{Red}}{Y_{Red\ Max\ Gray}}\right)}{\log\left(\frac{\mathrm{Red}_{Gray}}{\mathrm{Max\ Gray}}\right)}$$

$$\mathrm{Green\ Gamma} = \frac{\log\left(\frac{Y_{Green}}{Y_{GreenMax\ Gray}}\right)}{\log\left(\frac{\mathrm{Green}_{Gray}}{\mathrm{Max\ Gray}}\right)}$$

$$\mathrm{Blue\ Gamma} = \frac{\log\left(\frac{Y_{Blue}}{Y_{BlueMax\ Gray}}\right)}{\log\left(\frac{\mathrm{Blue}_{Gray}}{\mathrm{Max\ Gray}}\right)}.$$

The $Y_{Red\ Max\ Gray}$ may be a Y value emitted at a MaxGray of a red pixel. The $Y_{Green\ Max\ Gray}$ may be a Y value emitted at a MaxGray of a green pixel. The $Y_{Blue\ Max\ Gray}$ may be a Y value emitted at a MaxGray of a blue pixel. The $Y_{Red}$, the $Y_{Green}$ and the $Y_{Blue}$ may be Y values at a red pixel, a green pixel and a blue pixel of the displayed image respectively. The $\mathrm{Red}_{Gray}$, the $\mathrm{Green}_{Gray}$ and the $\mathrm{Blue}_{Gray}$ may be grayscale values at a red pixel, a green pixel and a blue pixel of the displayed image respectively.

In an exemplary embodiment, the $X_{RedMaxGray\text{-}1}$, the $Y_{RedMaxGray\text{-}1}$ and the $Z_{RedMaxGray\text{-}1}$ may have the same values as the $X_{RedMaxGray}$, the $Y_{RedMaxGray}$ and the $Z_{RedMaxGray}$ respectively. The $X_{GreenMaxGray\text{-}1}$, the $Y_{GreenMaxGray\text{-}1}$ and the $Z_{GreenMaxGray\text{-}1}$ may have the same values as the $X_{GreenMaxGray}$, the $Y_{GreenMaxGray}$ and the $Z_{GreenMaxGray}$ respectively. The $X_{BlueMaxGray\text{-}1}$, the $Y_{BlueMaxGray\text{-}1}$ and the $Z_{BlueMaxGray\text{-}1}$ may have the same values as the $X_{BlueMaxGray}$, the $Y_{BlueMaxGray}$ and the $Z_{BlueMaxGray}$ respectively.

In an exemplary embodiment, a ratio of X:Y:Z of measured value of the displayed image may be equal to a ratio of X:Y:Z of the red pixel, the green pixel and the blue pixel.

In an exemplary embodiment of method of correcting grayscale data according to the present inventive concept, the method includes measuring a tristimulus value of X, Y and Z values of a displayed image, generating a target curve with respect to the tristimulus value of X, Y and Z values of a displayed image, calculating target grayscale values of red pixel, green pixel and blue pixel using X, Y and Z values of the target curve, calculating a variation of a red pixel, a green pixel and a blue pixel using target grayscale values of a red pixel, a green pixel and a blue pixel and applying the variation of a red pixel, a green pixel and a blue pixel to a grayscale value corresponding to the displayed image to generate a corrected grayscale data.

In an exemplary embodiment, the target grayscale values of a red pixel, a green pixel and a blue pixel may be defined by the following Equations:

$$\mathrm{Red}_{Target\ Gray} = \mathrm{Max\ Gray} \times G_{Red\ target}^{\frac{1}{Red\ Gamma}}$$

$$\mathrm{Green}_{Target\ Gray} = \mathrm{Max\ Gray} \times G_{Green\ target}^{\frac{1}{Green\ Gamma}}$$

$$\mathrm{Blue}_{Target\ Gray} = \mathrm{Max\ Gray} \times G_{Blue\ target}^{\frac{1}{Blue\ Gamma}}.$$

The $\mathrm{Red}_{Target\ Gray}$ may be a red target grayscale value. The $\mathrm{Green}_{Target\ Gray}$ may be a green target grayscale value. The $\mathrm{Blue}_{Target\ Gray}$ may be a blue target grayscale value. The MaxGray may be a maximum grayscale value in a pixel. The $G_{Redtarget}$, the $G_{Greentarget}$ and the $G_{Bluetarget}$ may be defined by the following Equation:

$$\begin{pmatrix} G_{Red\ target} \\ G_{Green\ target} \\ G_{Bluetarget} \end{pmatrix} = \begin{pmatrix} X_{Red\ Max\ Gray-1} & X_{Green\ Max\ Gray-1} & X_{Blue\ Max\ Gray-1} \\ Y_{Red\ Max\ Gray-1} & Y_{Green\ Max\ Gray-1} & Y_{Blue\ Max\ Gray-1} \\ Z_{Red\ Max\ Gray-1} & Z_{Green\ Max\ Gray-1} & Y_{Blue\ Max\ Gray-1} \end{pmatrix}^{-1} \begin{pmatrix} X_{target} \\ Y_{target} \\ Z_{target} \end{pmatrix}$$

The $X_{target}$, the $Y_{target}$ and the $Z_{target}$ may be X, Y and Z values of the target curve respectively. The Red Gamma, the Green Gamma and the Blue Gamma may be defined by the following Equations:

$$\mathrm{Red\ Gamma} = \frac{\log\left(\frac{Y_{Red}}{Y_{Red\ Max\ Gray}}\right)}{\log\left(\frac{\mathrm{Red}_{Gray}}{\mathrm{Max\ Gray}}\right)}$$

-continued $$\text{Green Gamma} = \frac{\log\left(\frac{Y_{Green}}{Y_{GreenMax\ Gray}}\right)}{\log\left(\frac{\text{Green}_{Gray}}{\text{Max Gray}}\right)}$$

$$\text{Blue Gamma} = \frac{\log\left(\frac{Y_{Blue}}{Y_{BlueMax\ Gray}}\right)}{\log\left(\frac{\text{Blue}_{Gray}}{\text{Max Gray}}\right)}.$$

The $Y_{Red\ Max\ Gray}$ may be a Y value emitted at a MaxGray of a red pixel. The $Y_{Green\ Max\ Gray}$ may be a Y value emitted at a MaxGray of a green pixel. The $Y_{Blue\ Max\ Gray}$ may be a Y value emitted at a MaxGray of a blue pixel. The $Y_{Red}$, the $Y_{Green}$ and the $Y_{Blue}$ may be Y values at a red pixel, Y a green pixel and a blue pixel of the displayed image respectively. The $\text{Red}_{Gray}$, the $\text{Green}_{Gray}$ and the $\text{Blue}_{Gray}$ may be grayscale values at a red pixel, a green pixel and a blue pixel of the displayed image respectively.

In an exemplary embodiment, the $X_{RedMaxGray\text{-}1}$, the $Y_{RedMaxGray\text{-}1}$ and the $Z_{RedmaxGray\text{-}1}$ may have the same values as the $X_{RedMaxGray}$, the $Y_{RedMaxGray}$ and the $Z_{RedMaxGray}$ respectively. The $X_{GreenMaxGray\text{-}1}$, the $Y_{GreenMaxGray\text{-}1}$ and the $Z_{GreenMaxGray\text{-}1}$ may have the same values as the $X_{GreenMaxGray}$, the $Y_{GreenMaxGray}$ and the $Z_{GreenMaxGray}$ respectively. The $X_{BlueMaxGray\text{-}1}$, the $Y_{BlueMaxGray\text{-}1}$ and the $Z_{BlueMaxGray\text{-}1}$ may have the same values as the $X_{BlueMaxGray}$, the $Y_{BlueMaxGray}$ and the $Z_{BlueMaxGray}$ respectively.

In an exemplary embodiment, a ratio of X:Y:Z of measured value of the displayed image may be equal to a ratio of X:Y:Z of the red pixel, the green pixel and the blue pixel.

According to the present inventive concept as explained above, when a gray scale data for correcting a color stain is calculated, an Equation capable of simplifying a calculation. Therefore, resources for correcting a color stain may be saved.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE INVENTION

Hereinafter, the present invention will be explained in detail with reference to the accompanying drawings. Note that reference to a red pixel, a green pixel and a blue pixel is with respect to a reference pixel, wherein the red, green and blue pixels are subpixels of the reference pixel.

Figure 1:
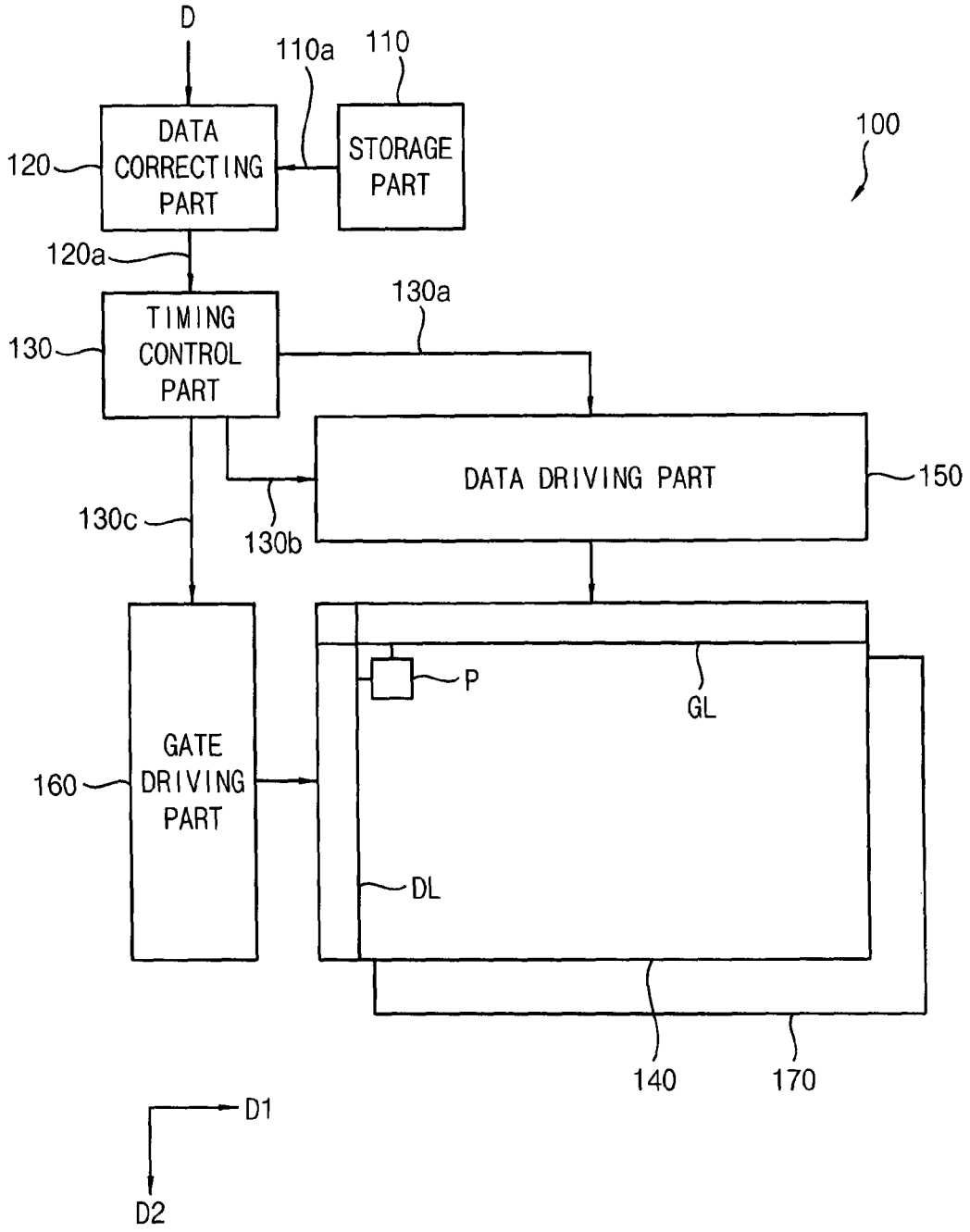
FIG. 1 is a block diagram illustrating a display apparatus according to an exemplary embodiment of the inventive concept.

FIG. 1 is a block diagram illustrating a display apparatus according to an exemplary embodiment of the inventive concept.

Referring to FIG. 1, the display apparatus 100 may include a storage part 110, a data correcting part 120, a timing control part 130, a display panel 140, a data driving part 150, a gate driving part 160 and a light-source part 170.

Grayscale correction values of a reference pixel respectively corresponding to a plurality of sample grayscales are stored in the storage part 110.

The data correcting part 120 corrects grayscale data D utilizing the grayscale correction value 110*a* stored in the storage part 110 and generates corrected grayscale data 120*a*. Hereinafter, a method of correcting the grayscale data by the data correcting part 120 will be explained.

The timing control part 130 drives the data driving part 140 based on the corrected grayscale data 120*a* received from the data correcting part 120. For example, the timing control part 130 may correct the corrected grayscale data through various compensation algorithms for a response time, a white, etc and provide the data driving part 140 with the corrected grayscale data 130*a*.

In addition, the timing control part 130 generates a data control signal 130*b* to control the data driving part 140 and a gate control signal 130*c* to control the gate driving part 150. The timing control part 130 controls the data driving part 140 based on the data control signal 130*b* and controls the gate driving part 150 based on the gate control signal 130*c*.

The display panel 140 includes a plurality of data lines DL, a plurality of gate lines GL and a plurality of pixels P which is arranged as a matrix type. The data lines DL extend in a direction D2, are electrically connected to output terminals of the data driving part 150 and receive data voltages. The gate lines GL extend in a direction D1 crossing the direction D2, are electrically connected to output terminals of the gate driving part 160 and sequentially receive gate signals. Each of the pixels includes a plurality of sub color pixels.

The data driving part 150 converts the corrected grayscale data to the data voltage utilizing a gamma voltage and provides the data line DL of the display panel 140 with the data voltage based on a control of the timing control part 130.

The gate driving part 160 generates the gate signal and provides the gate line GL of the display panel 140 with the gate signal based on the control of the timing control part 130.

The light-source part 170 includes at least one light-source which generates light and provides the display panel 140 with the light. The light-source part 170 may be a direct-illumination type or an edge-illumination type.

Figure 2:
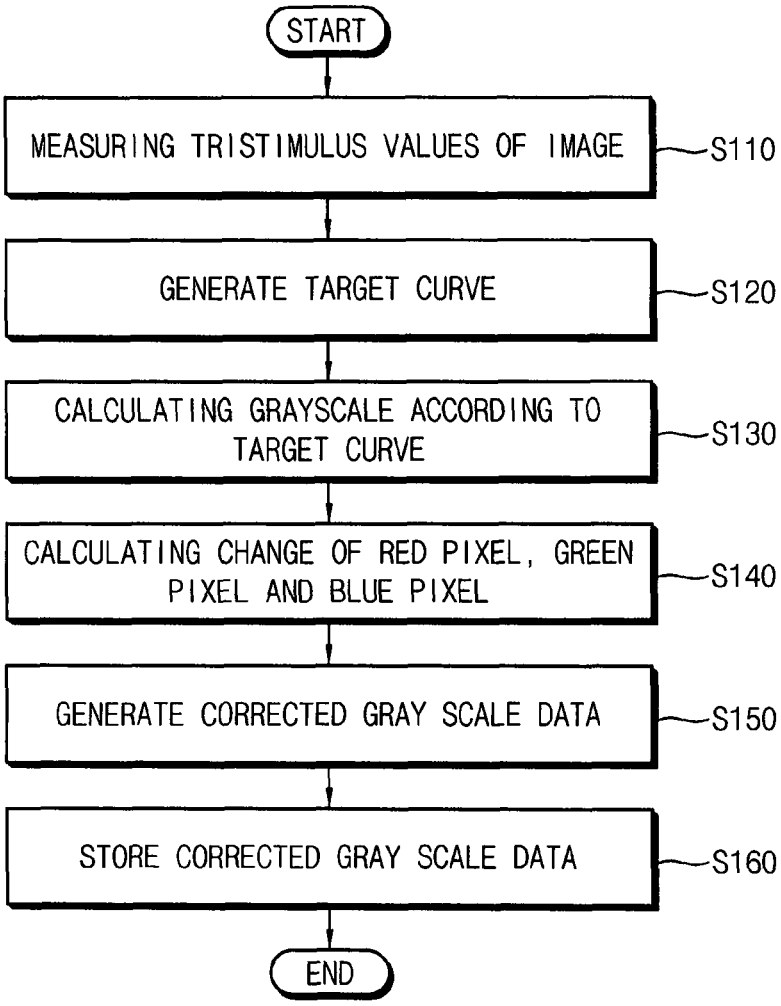
FIG. 2 is a flowchart view illustrating the method of calculating a grayscale correction value according to an exemplary embodiment of the inventive concept.
Figure 3:
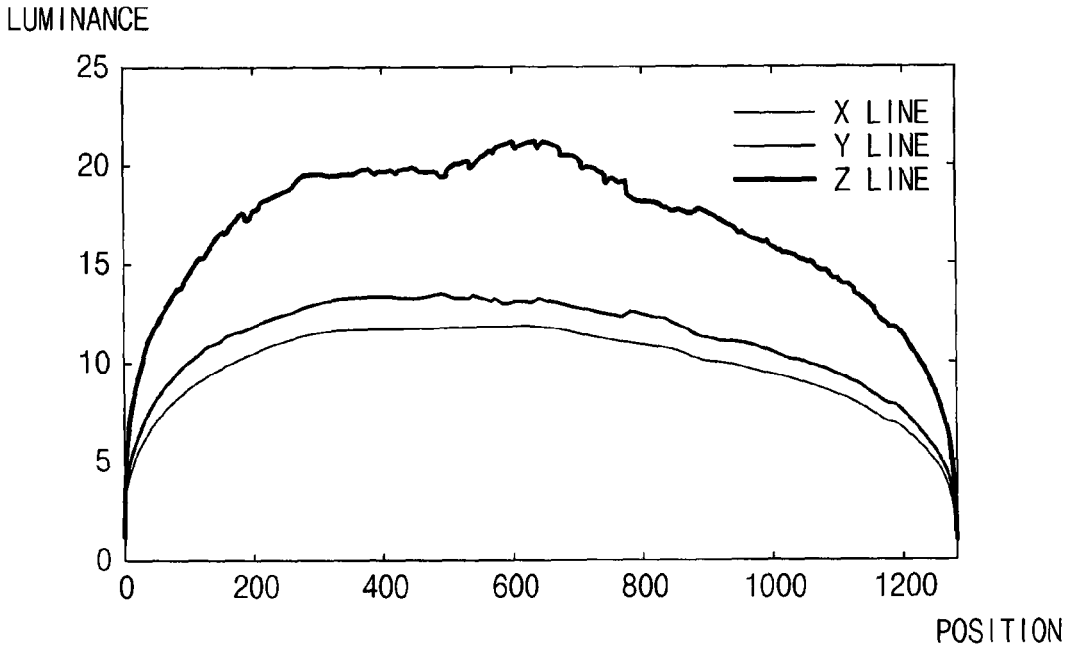
FIG. 3 is a conceptual diagram illustrating tristimulus values of X, Y and Z values of a displayed image for use in a method of calculating a grayscale correction value of FIG. 2.
Figure 4:
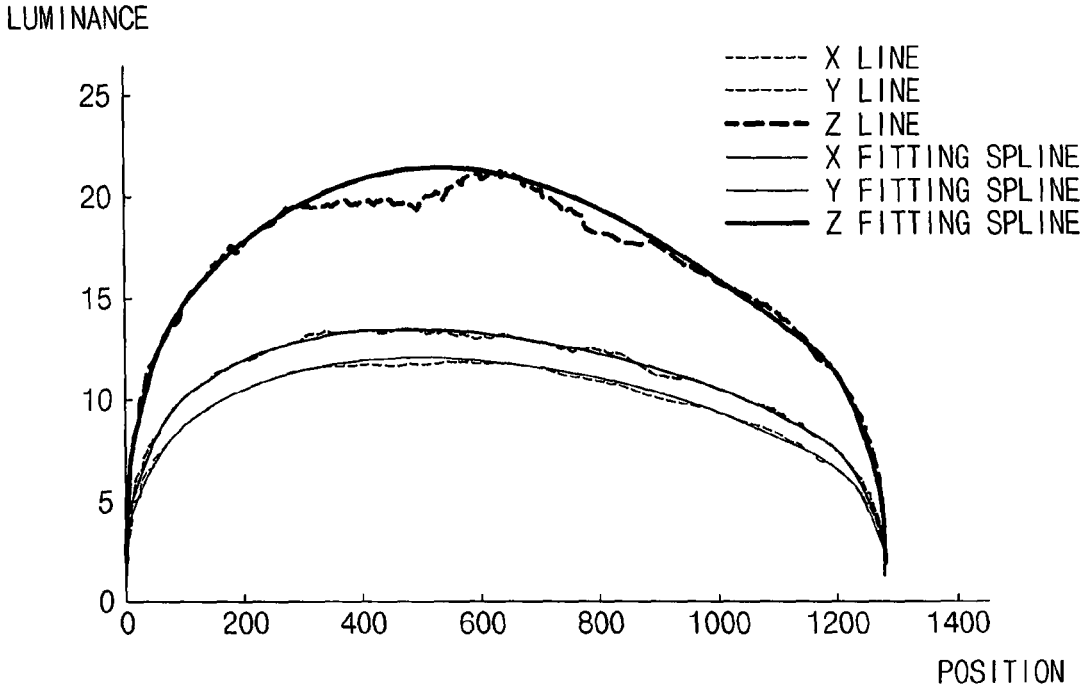
FIG. 4 is a conceptual diagram illustrating the tristimulus values of X, Y and Z values of a displayed image and their respective target curves for use in a method of calculating a grayscale correction value of FIG. 2.
Figure 5:
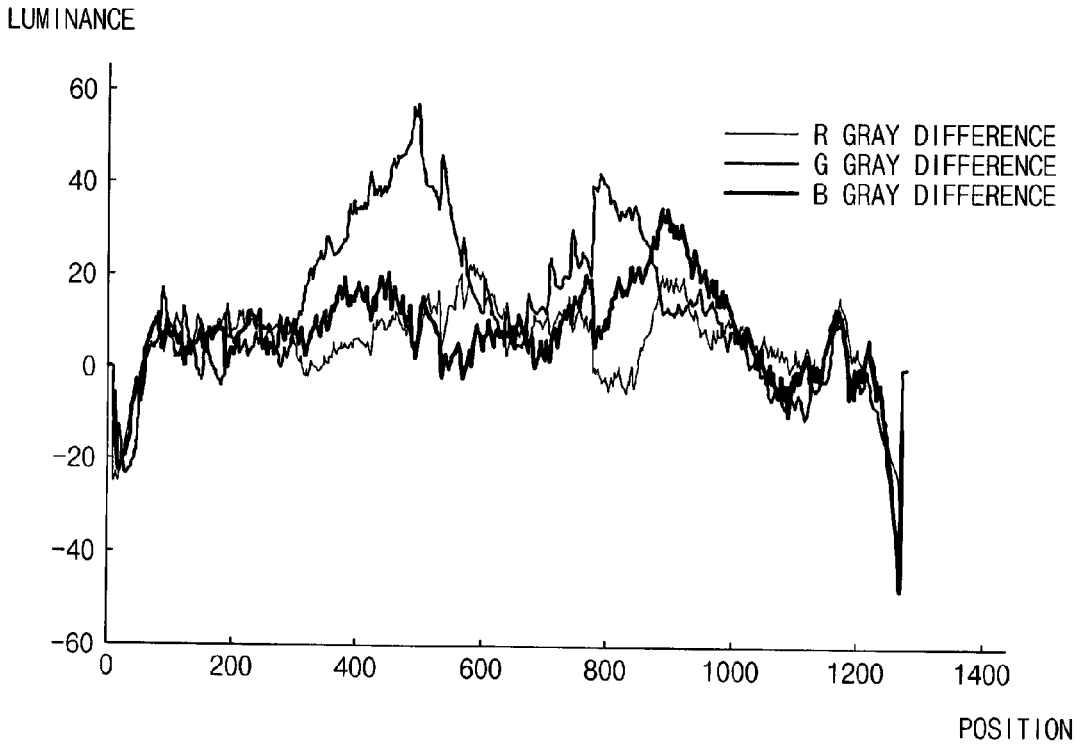
FIG. 5 is a conceptual diagram illustrating a method of calculating a grayscale correction value of FIG. 2.

FIG. 2 is a flowchart view illustrating the method of calculating a grayscale correction value according to an exemplary embodiment of the inventive concept. FIG. 3 is a conceptual diagram illustrating tristimulus values of X, Y and Z values of a displayed image for use in a method of calculating a grayscale correction value of FIG. 2. FIG. 4 is a conceptual diagram illustrating a method of calculating a grayscale correction value of FIG. 2. FIG. 5 is a conceptual diagram illustrating a method of calculating a grayscale correction value of FIG. 2. Referring to FIGS. 2 to 5, a tristimulus value of X, Y and Z values of a displayed image is measured S110.

When a stain based on a luminance of a display panel is corrected, only one value is corrected. However, when a stain based on a color of a display panel is corrected, tristimulus values of X, Y and Z values of a displayed image are corrected respectively. Thus, when a stain based on a color of a display panel is corrected, three values are corrected.

Referring to FIG. 3, the tristimulus values of X, Y and Z values of a displayed image may be illustrated as a graph. The X, Y, Z values are graphed onto irregular lines X line, Y line and Z line, respectively, since the illustrated graph lines are not curves that increase or decrease at a constant rate according to a position.

A target curve with respect to the tristimulus values of X, Y and Z values of a displayed image may be generated S120.

Referring to FIG. 4, the tristimulus values of X, Y and Z values of a displayed image and the target curve with respect to the tristimulus value of X, Y and Z values of a displayed image may be illustrated as a graph. However, a graph with respect to the target curve with respect to the tristimulus values of X, Y and Z values of a displayed image may be illustrated as a relatively regular lines X FITTING SPLINE, Y FITTING SPLINE and Z FITTING SPLINE.

After the target curve is generated, X, Y and Z values with respect to the target curve is calculated S130. The X, Y and Z values with respect to the target curve may be defined by the following Equation.

$$\begin{pmatrix} G_{Red\ target} \\ G_{Green\ target} \\ G_{Bluetarget} \end{pmatrix} = \begin{pmatrix} X_{Red\ Max\ Gray-1} & X_{Green\ Max\ Gray-1} & X_{Blue\ Max\ Gray-1} \\ Y_{Red\ Max\ Gray-1} & Y_{Green\ Max\ Gray-1} & Y_{Blue\ Max\ Gray-1} \\ Z_{Red\ Max\ Gray-1} & Z_{Green\ Max\ Gray-1} & Y_{Blue\ Max\ Gray-1} \end{pmatrix}^{-1} \begin{pmatrix} X_{target} \\ Y_{target} \\ Z_{target} \end{pmatrix} \quad \text{Equation 1}$$

Herein, $X_{target}$, the $Y_{target}$ and the $Z_{target}$ is X, Y and Z values of the target curve respectively.

Following Equations may be used for defining the Equation 1.

$$\begin{bmatrix} X_{Gray} \\ Y_{Gray} \\ Z_{Gray} \end{bmatrix} = \begin{bmatrix} X_{Red} & X_{Green} & X_{Blue} \\ Y_{Red} & Y_{Green} & Y_{Blue} \\ Z_{Red} & Z_{Green} & Z_{Blue} \end{bmatrix} \quad \text{Equation 2}$$

Herein, the $X_{Red}$ is X value emitted at a red pixel, the $Y_{Red}$ is Y value emitted at a red pixel and the $Z_{Red}$ is Z value emitted at a red pixel. In addition, X, Y and Z value at a green pixel and a blue pixel may be expressed as the same manner. A black may be regarded to be zero.

In addition, when an arbitrary measured grayscale is a Gray, it may be regarded that a gamma value of a variable Gray is substantially equal to a gamma value of a measured Gray in order to generalize the measured Gray into a variable. Therefore, following conditions may be established.

Condition 1

A gamma value of a variable Gray is substantially equal to a gamma value of a measured Gray.

Condition 2

A ratio of X:Y:Z of measured value of the displayed image is equal to a ratio of X:Y:Z of the red pixel, the green pixel and the blue pixel.

Referring to Equation 2, since a sub pixel includes a red pixel, a green pixel and a blue pixel, a Gray value of the X, the Y and the Z may be calculated as the sum emitted values at a red pixel, a green pixel and a blue pixel.

In addition, following Equation may be defined due to a relation between the Gray value and the Gamma value.

$$Y_{Red} = Y_{Red\ Max\ Gray} \times \left(\frac{\text{Red}_{Gray}}{\text{Max Gray}}\right)^{Red\ Gamma} \quad \text{Equation 3}$$

$$Y_{Green} = Y_{GreenMax\ Gray} \times \left(\frac{\text{Green}_{Gray}}{\text{Max Gray}}\right)^{GreenGamma}$$

$$Y_{Blue} = Y_{BlueMax\ Gray} \times \left(\frac{\text{Blue}_{Gray}}{\text{Max Gray}}\right)^{Blue\ Gamma}$$

Herein, the $Y_{Red\ Max\ Gray}$ is a Y value emitted at a MaxGray of a red pixel, the $Y_{Green\ Max\ Gray}$ is a Y value emitted at a MaxGray of a green pixel and the $Y_{Blue\ Max\ Gray}$ is a Y value emitted at a MaxGray of a blue pixel. In addition, X and Z value may be expressed as the same manner.

The Red Gamma, the Green Gamma and the Blue Gamma is defined by the following Equation using the Equation 3.

$$\text{Red Gamma} = \frac{\log\left(\frac{Y_{Red}}{Y_{Red\ Max\ Gray}}\right)}{\log\left(\frac{\text{Red}_{Gray}}{\text{Max Gray}}\right)} \quad \text{Equation 4}$$

$$\text{Green Gamma} = \frac{\log\left(\frac{Y_{Green}}{Y_{GreenMax\ Gray}}\right)}{\log\left(\frac{\text{Green}_{Gray}}{\text{Max Gray}}\right)}$$

$$\text{Blue Gamma} = \frac{\log\left(\frac{Y_{Blue}}{Y_{BlueMax\ Gray}}\right)}{\log\left(\frac{\text{Blue}_{Gray}}{\text{Max Gray}}\right)}$$

A portion of the Equation 3 may be substituted as a following Equation in order to simplify calculations of the Equation 3 and the Equation 4.

$$\left(\frac{\text{Red}_{Gray}}{\text{Max Gray}}\right)^{Red\ Gamma} = G_{red} \quad \text{Equation 5}$$

$$\left(\frac{\text{Green}_{Gray}}{\text{Max Gray}}\right)^{GreenGamma} = G_{Green}$$

$$\left(\frac{\text{Blue}_{Gray}}{\text{Max Gray}}\right)^{Blue\ Gamma} = G_{Blue}$$

In addition, when the substituted values are substituted to the Equation 3, a following Equation may be defined.

$$\begin{pmatrix} X_{Gray} \\ Y_{Gray} \\ Z_{Gray} \end{pmatrix} = \begin{pmatrix} X_{Red\ Max\ Gray} & X_{GreenMax\ Gray} & X_{BlueMax\ Gray} \\ Y_{Red\ Max\ Gray} & Y_{GreenMax\ Gray} & Y_{BlueMax\ Gray} \\ Z_{Red\ Max\ Gray} & Z_{GreenMax\ Gray} & Z_{BlueMax\ Gray} \end{pmatrix} \begin{pmatrix} G_{red} \\ G_{green} \\ G_{Blue} \end{pmatrix} \quad \text{Equation 6}$$

In addition, the X, the Y and the Z may be substituted as a following Equation in order to apply the Condition 2 to the Equation 6.

$$X_{Red\ Max\ Gray} \rightarrow X_{Red} \times \frac{Y_{Red\ Max\ Gray}}{Y_{Red}} = X_{Red\ Max\ Gray-1} \quad \text{Equation 7}$$

$$Y_{Red\ Max\ Gray} \rightarrow Y_{Red\ Max\ Gray-1}$$

$$Z_{Red\ Max\ Gray} \rightarrow Z_{Red} \times \frac{Y_{Red\ Max\ Gray}}{Y_{Red}} = Z_{Red\ Max\ Gray-1}$$

Herein, the X, the Y and the Z are substituted with respect to the Y in order to minimize an error. In addition, a green pixel and the blue pixel may be substituted as the same manner.

The Equation 6 is applied to the Equation 7, so that a target Gray may be defined by a following Equation.

$$\begin{pmatrix} X_{target} \\ Y_{target} \\ Z_{target} \end{pmatrix} = \begin{pmatrix} X_{Red\ Max\ Gray-1} & X_{GreenMax\ Gray-1} & X_{BlueMax\ Gray-1} \\ Y_{Red\ Max\ Gray-1} & Y_{GreenMax\ Gray-1} & Y_{BlueMax\ Gray-1} \\ Z_{Red\ Max\ Gray-1} & Z_{GreenMax\ Gray-1} & Z_{BlueMax\ Gray-1} \end{pmatrix} \begin{pmatrix} G_{Red\ target} \\ G_{Greentarget} \\ G_{Bluetarget} \end{pmatrix} \quad \text{Equation 8}$$

An inverse matrix of the Equation 8 may be calculated in order to calculate a target Gray using the $X_{target}$, the $Y_{target}$ and the $Z_{target}$ of the Equation 8. When the inverse matrix of the Equation 8 is calculated, the Equation 1 is defined.

A variation of a red pixel, a green pixel and a blue pixel is calculated using target grayscale values of a red pixel, a green pixel and a blue pixel S140.

When a gamma value calculated in the Equation 4 applies to a G value calculated in the Equation 1, target grayscale values of a red pixel, a green pixel and a blue pixel may be defined by the following Equation.

$$\text{Red}_{Target\ Gray} = \text{Max Gray} \times G_{Red\ target}^{\frac{1}{Red\ Gamma}}$$

$$\text{Green}_{Target\ Gray} = \text{Max Gray} \times G_{Green\ target}^{\frac{1}{Green\ Gamma}}$$

$$\text{Blue}_{Target\ Gray} = \text{Max Gray} \times G_{Blue\ target}^{\frac{1}{Blue\ Gamma}}$$

Therefore, when difference between the target grayscale values of a red pixel, a green pixel and a blue pixel calculated in the Equation 9 and Gray values of input pixels, variation of a red pixel, a green pixel and a blue pixel may be calculated.

A corrected grayscale data may be generated using the variation of a red pixel, a green pixel and a blue pixel S150. When the variation of a red pixel, a green pixel and a blue pixel has value of "−", the corrected grayscale data has value of "+". In addition, when the variation of a red pixel, a green pixel and a blue pixel has value of "+", the corrected grayscale data has value of "−".

Thereafter, the corrected grayscale data may be stored S160.

Figure 6:
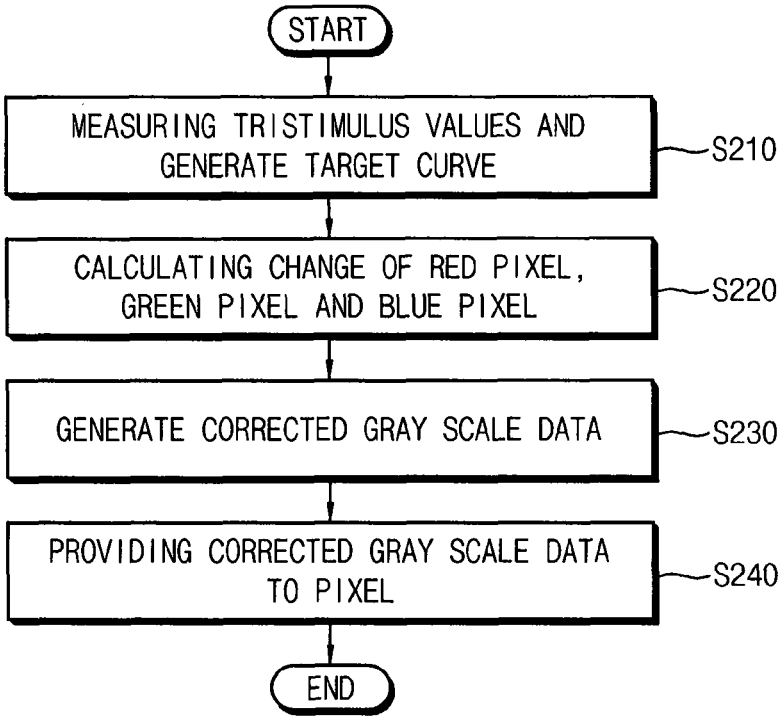
FIG. 6 is a flowchart view illustrating a method of displaying an image according to the display apparatus shown in FIG. 1.

FIG. 6 is a flowchart view illustrating a method of displaying an image according to the display apparatus shown in FIG. 1.

Referring to FIGS. 1 and 6, the data correcting part 120 corrects grayscale data D utilizing the grayscale correction value 110*a* stored in the storage part 110 and generates corrected grayscale data 120*a*.

In the data correcting part 120, tristimulus values of X, Y and Z values of a displayed image may be measured. Thereafter, a target curve with respect to the tristimulus value of X, Y and Z values of a displayed image may be generated S210.

Thereafter, a variation of a red pixel, a green pixel and a blue pixel may be calculated using target grayscale values of a red pixel, a green pixel and a blue pixel S220. The variation of a red pixel, a green pixel and a blue pixel may be calculated using the Equation 9.

A corrected grayscale data may be generated using the variation of a red pixel, a green pixel and a blue pixel S230. When the variation of a red pixel, a green pixel and a blue pixel has value of "−", the corrected grayscale data has value of "+". In addition, when the variation of a red pixel, a green pixel and a blue pixel has value of "+", the corrected grayscale data has value of "−".

Thereafter, the corrected grayscale data may be applied to a pixel S240. The timing control part 130 provides the data driving part 150 with the received data based on a vertical synchronization signal and a horizontal synchronization signal. The data driving part 150 converts the corrected grayscale data to the data voltage utilizing a gamma voltage and provides the data line DL of the display panel 140 with the data voltage based on a control of the timing control part 130.

According to the present inventive concept as explained above, when a gray scale data for correcting a color stain is calculated, an Equation capable of simplifying a calculation. Therefore, resources for correcting a color stain may be saved.

The foregoing is illustrative of the present invention and is not to be construed as limiting thereof. Although a few exemplary embodiments of the present invention have been described, those skilled in the art will readily appreciate that many modifications are possible in the exemplary embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific exemplary embodiments disclosed, and that modifications to the disclosed exemplary embodiments, as well as other exemplary embodiments, are intended to be included within the scope of the appended claims. The present inventive concept is defined by the following claims, with equivalents of the claims to be included therein.

What is claimed is:

1. A method of displaying an image on a display panel which comprises a plurality of pixels arranged as a matrix type, the method comprising:

measuring a tristimulus value of X, Y and Z values of a displayed image;

generating a target curve using the measured tristimulus value of X, Y and Z values;

generating corrected grayscale data of a red pixel, a green pixel and a blue pixel using the X, Y and Z values of the target curve; and converting the corrected grayscale data to a data voltage to provide a data line of the display panel with the data voltage, wherein the generating corrected grayscale data comprises:

calculating target grayscale values of the red pixel, the green pixel and the blue pixel using the X, Y and Z values of the target curve;

calculating a variation of the red pixel, the green pixel and the blue pixel using the calculated target grayscale values of the red pixel, the green pixel and the blue pixel; and applying the variation of the red pixel, the green pixel and the blue pixel to a grayscale value corresponding to the displayed image to generate a corrected grayscale data, wherein the target grayscale values of the red pixel, the green pixel and the blue pixel are defined by the following Equations:

$$\mathrm{Red}_{Target\ Gray} = \mathrm{Max\ Gray} \times G_{Red\ target}^{\frac{1}{Red\ Gamma}}$$

$$\mathrm{Green}_{Target\ Gray} = \mathrm{Max\ Gray} \times G_{Green\ target}^{\frac{1}{Green\ Gamma}}$$

$$\mathrm{Blue}_{Target\ Gray} = \mathrm{Max\ Gray} \times G_{Blue\ target}^{\frac{1}{Blue\ Gamma}}$$

wherein the $\mathrm{Red}_{Target\ Gray}$ is a red target grayscale value, the $\mathrm{Green}_{Target\ Gray}$ is a green target grayscale value, the $\mathrm{Blue}_{Target\ Gray}$ is a blue target grayscale value and the MaxGray is a maximum grayscale value in a pixel, and wherein the $G_{Redtarget}$, the $G_{Greentarget}$ and the $G_{Bluetarget}$ are defined by the following Equation:

$$\begin{pmatrix} G_{Red\ target} \\ G_{Green\ target} \\ G_{Bluetarget} \end{pmatrix} = \begin{pmatrix} X_{Red\ Max\ Gray-1} & X_{GreenMax\ Gray-1} & X_{BlueMax\ Gray-1} \\ Y_{Red\ Max\ Gray-1} & Y_{GreenMax\ Gray-1} & Y_{BlueMax\ Gray-1} \\ Z_{Red\ Max\ Gray-1} & Z_{GreenMax\ Gray-1} & Z_{BlueMax\ Gray-1} \end{pmatrix}^{-1} \begin{pmatrix} X_{target} \\ Y_{target} \\ Z_{target} \end{pmatrix}$$

wherein the $X_{target}$, the $Y_{target}$ and the $Z_{target}$ are the X, Y and Z values of the target curve respectively, and wherein the Red Gamma, the Green Gamma and the Blue Gamma are defined by the following Equations:

$$\text{Red Gamma} = \frac{\log\left(\frac{Y_{Red}}{Y_{Red\ Max\ Gray}}\right)}{\log\left(\frac{\mathrm{Red}_{Gray}}{\text{Max Gray}}\right)}$$

$$\text{Green Gamma} = \frac{\log\left(\frac{Y_{Green}}{Y_{GreenMax\ Gray}}\right)}{\log\left(\frac{\mathrm{Green}_{Gray}}{\text{Max Gray}}\right)}$$

$$\text{Blue Gamma} = \frac{\log\left(\frac{Y_{Blue}}{Y_{BlueMax\ Gray}}\right)}{\log\left(\frac{\mathrm{Blue}_{Gray}}{\text{Max Gray}}\right)}$$

wherein the $Y_{Red\ Max\ Gray}$ is a Y value emitted at a MaxGray of the red pixel, the $Y_{Green\ Max\ Gray}$ is a Y value emitted at a MaxGray of the green pixel, the $Y_{Blue\ Max\ Gray}$ is a Y value emitted at a MaxGray of the blue pixel, the $Y_{Red}$, the $Y_{Green}$ and the $Y_{Blue}$ are Y values at the red pixel, the green pixel and the blue pixel of the displayed image respectively and the $\mathrm{Red}_{Gray}$, the $\mathrm{Green}_{Gray}$ and the $\mathrm{Blue}_{Gray}$ are grayscale values at the red pixel, the green pixel and the blue pixel of the displayed image respectively.

2. The method of claim 1, wherein the $X_{RedMaxGray\text{-}1}$, the $Y_{RedMaxGray\text{-}1}$ and the $Z_{RedMaxGray\text{-}1}$ have the same values as the $X_{RedMaxGray}$, the $Y_{RedMaxGray}$ and the $Z_{RedMaxGray}$ respectively, and the $X_{GreenMaxGray\text{-}1}$, the $Y_{GreenMaxGray\text{-}1}$ and the $Z_{GreenMaxGray\text{-}1}$ have the same values as the $X_{GreenMaxGray}$, the $Y_{GreenMaxGray}$ and the $Z_{GreenMaxGray}$ respectively, and the $X_{GreenMaxGray\text{-}1}$, the $Y_{BlueMaxGray\text{-}1}$ and the $Z_{BlueMaxGray\text{-}1}$ have the same values as the $X_{BlueMaxGray}$, the $Y_{BlueMaxGray}$ and the $Z_{BlueMaxGray}$ respectively.

3. The method of claim 1, wherein a ratio of X:Y:Z of measured values of the displayed image is equal to a ratio of X:Y:Z of the red pixel, the green pixel and the blue pixel.

4. A display apparatus comprising:

a display panel which comprises a plurality of pixels arranged as a matrix type;

a storage part configured to store a grayscale correction value of a reference pixel respectively corresponding to a plurality of sample grayscales, the reference pixel comprising to m×n pixels ('m' and 'n' are a natural number);

a data correction part configured to generate corrected grayscale data utilizing a grayscale correction value of the reference pixel; and a data driving part configured to generate data voltages based on the corrected grayscale data and to provide the data lines with the data voltages, wherein the data correction part is configured to measure tristimulus values of X, Y and Z values of a displayed image, configured to generate a target curve with respect to the tristimulus values of X, Y and Z values of the displayed image, configured to calculate target grayscale values of a red pixel, a green pixel and a blue pixel using the X, Y and Z values of the target curve, configured to calculate a variation of the red pixel, the green pixel and the blue pixel using the target grayscale values of the red pixel, the green pixel and the blue pixel, and configured to apply the variation of the red pixel, the green pixel and the blue pixel to a grayscale value corresponding to the displayed image to generate a corrected grayscale data, wherein the target grayscale values of the red pixel, the green pixel and the blue pixel are defined by the following Equations:

$$\mathrm{Red}_{Target\ Gray} = \mathrm{Max\ Gray} \times G_{Red\ target}^{\frac{1}{Red\ Gamma}}$$

$$\mathrm{Green}_{Target\ Gray} = \mathrm{Max\ Gray} \times G_{Green\ target}^{\frac{1}{Green\ Gamma}}$$

$$\mathrm{Blue}_{Target\ Gray} = \mathrm{Max\ Gray} \times G_{Blue\ target}^{\frac{1}{Blue\ Gamma}}$$

wherein the $\mathrm{Red}_{Target\ Gray}$ is a red target grayscale value, the $\mathrm{Green}_{Target\ Gray}$ is a green target grayscale value, the $\mathrm{Blue}_{Target\ Gray}$ is a blue target grayscale value and the MaxGray is a maximum grayscale value in a pixel, and wherein the $G_{Red\ target}$, the $G_{Green\ target}$ and the $G_{Blue\ target}$ are defined by the following Equation:

$$\begin{pmatrix} G_{Red\ target} \\ G_{Green\ target} \\ G_{Bluetarget} \end{pmatrix} = \begin{pmatrix} X_{Red\ Max\ Gray-1} & X_{GreenMax\ Gray-1} & X_{BlueMax\ Gray-1} \\ Y_{Red\ Max\ Gray-1} & Y_{GreenMax\ Gray-1} & Y_{BlueMax\ Gray-1} \\ Z_{Red\ Max\ Gray-1} & Z_{GreenMax\ Gray-1} & Z_{BlueMax\ Gray-1} \end{pmatrix}^{-1} \begin{pmatrix} X_{target} \\ Y_{target} \\ Z_{target} \end{pmatrix}$$

wherein the $X_{target}$, the $Y_{target}$ and the $Z_{target}$ are X, Y and Z values of the target curve respectively, and wherein the Red Gamma, the Green Gamma and the Blue Gamma are defined by the following Equations:

$$\text{Red Gamma} = \frac{\log\left(\frac{Y_{Red}}{Y_{Red\ Max\ Gray}}\right)}{\log\left(\frac{\mathrm{Red}_{Gray}}{\mathrm{Max\ Gray}}\right)}$$

$$\text{Green Gamma} = \frac{\log\left(\frac{Y_{Green}}{Y_{GreenMax\ Gray}}\right)}{\log\left(\frac{\mathrm{Green}_{Gray}}{\mathrm{Max\ Gray}}\right)}$$

$$\text{Blue Gamma} = \frac{\log\left(\frac{Y_{Blue}}{Y_{BlueMax\ Gray}}\right)}{\log\left(\frac{\mathrm{Blue}_{Gray}}{\mathrm{Max\ Gray}}\right)}$$

wherein the $Y_{Red\ Max\ Gray}$ is a Y value emitted at a MaxGray of the red pixel, the $Y_{Green\ Max\ Gray}$ is a Y value emitted at a MaxGray of the green pixel, the $Y_{Blue\ Max\ Gray}$ is a Y value emitted at a MaxGray of the blue pixel, the $Y_{Red}$, the $Y_{Green}$ and the $Y_{Blue}$ are Y values at the red pixel, the green pixel and the blue pixel of the displayed image respectively and the $\mathrm{Red}_{Gray}$, the $\mathrm{Green}_{Gray}$ and the $\mathrm{Blue}_{Gray}$ are grayscale values at the red pixel, the green pixel and the blue pixel of the displayed image respectively.

5. The display apparatus of claim 4, wherein the $X_{RedMaxGray\text{-}1}$, the $Y_{RedMaxGray\text{-}1}$ and the $Z_{RedMaxGray\text{-}1}$ have the same values as the $X_{RedMaxGray}$, the $Y_{RedMaxGray}$ and the $Z_{RedMaxGray}$ respectively, and the $X_{GreenMaxGray\text{-}1}$, the $Y_{GreenMaxGray\text{-}1}$ and the $Z_{GreenMaxGray\text{-}1}$ have the same values as the $X_{GreenMaxGray}$, the $Y_{GreenMaxGray}$ and the $Z_{GreenMaxGray}$ respectively, and the $X_{BlueMaxGray\text{-}1}$, the $Y_{BlueMaxGray\text{-}1}$ and the $Z_{BlueMaxGray\text{-}1}$ have the same values as the $X_{BlueMaxGray}$, the $Y_{BlueMaxGray}$ and the $Z_{BlueMaxGray}$ respectively.

6. The display apparatus of claim 4, wherein a ratio of X:Y:Z of measured values of the displayed image is equal to a ratio of X:Y:Z of the red pixel, the green pixel and the blue pixel.

7. A method of calculating a correction value, the method comprising:

measuring a tristimulus value of X, Y and Z values of a displayed image;

generating a target curve with respect to the tristimulus value of X, Y and Z values of the displayed image;

calculating target grayscale values of a red pixel, a green pixel and a blue pixel using the X, Y and Z values of the target curve; and calculating a variation of the red pixel, the green pixel and the blue pixel using the target grayscale values of the red pixel, the green pixel and the blue pixel, wherein the target grayscale values of the red pixel, the green pixel and the blue pixel are defined by the following Equations:

$$\mathrm{Red}_{Target\ Gray} = \mathrm{Max\ Gray} \times G_{Red\ target}^{\frac{1}{Red\ Gamma}}$$

$$\mathrm{Green}_{Target\ Gray} = \mathrm{Max\ Gray} \times G_{Green\ target}^{\frac{1}{Green\ Gamma}}$$

$$\mathrm{Blue}_{Target\ Gray} = \mathrm{Max\ Gray} \times G_{Blue\ target}^{\frac{1}{Blue\ Gamma}}$$

wherein the $\mathrm{Red}_{Target\ Gray}$ is a red target grayscale value, the $\mathrm{Green}_{Target\ Gray}$ is a green target grayscale value, the $\mathrm{Blue}_{Target\ Gray}$ is a blue target grayscale value and the MaxGray is a maximum grayscale value in a pixel, and wherein the $G_{Redtarget}$, the $G_{Greentarget}$ and the $G_{Bluetarget}$ are defined by the following Equation:

$$\begin{pmatrix} G_{Red\ target} \\ G_{Green\ target} \\ G_{Bluetarget} \end{pmatrix} = \begin{pmatrix} X_{Red\ Max\ Gray-1} & X_{GreenMax\ Gray-1} & X_{BlueMax\ Gray-1} \\ Y_{Red\ Max\ Gray-1} & Y_{GreenMax\ Gray-1} & Y_{BlueMax\ Gray-1} \\ Z_{Red\ Max\ Gray-1} & Z_{GreenMax\ Gray-1} & Z_{BlueMax\ Gray-1} \end{pmatrix}^{-1} \begin{pmatrix} X_{target} \\ Y_{target} \\ Z_{target} \end{pmatrix}$$

wherein the $X_{target}$, the $Y_{target}$ and the $Z_{target}$ are X, Y and Z values of the target curve respectively, and wherein the Red Gamma, the Green Gamma and the Blue Gamma are defined by the following Equations:

$$\text{Red Gamma} = \frac{\log\left(\frac{Y_{Red}}{Y_{Red\ Max\ Gray}}\right)}{\log\left(\frac{\mathrm{Red}_{Gray}}{\mathrm{Max\ Gray}}\right)}$$

$$\text{Green Gamma} = \frac{\log\left(\frac{Y_{Green}}{Y_{GreenMax\ Gray}}\right)}{\log\left(\frac{\mathrm{Green}_{Gray}}{\mathrm{Max\ Gray}}\right)}$$

-continued $$\text{Blue Gamma} = \frac{\log\left(\frac{Y_{Blue}}{Y_{BlueMax\ Gray}}\right)}{\log\left(\frac{\text{Blue}_{Gray}}{\text{Max Gray}}\right)}$$

wherein the $Y_{Red\ Max\ Gray}$ is a Y value emitted at a MaxGray of the red pixel, the $Y_{Green\ Max\ Gray}$ is a Y value emitted at a MaxGray of the green pixel, the $Y_{Blue\ Max\ Gray}$ is a Y value emitted at a MaxGray of the blue pixel, the $Y_{Red}$, the $Y_{Green}$ and the $Y_{Blue}$ are Y values at the red pixel, the green pixel and the blue pixel of the displayed image respectively and the $\text{Red}_{Gray}$, the $\text{Green}_{Gray}$ and the $\text{Blue}_{Gray}$ are grayscale values at the red pixel, the green pixel and the blue pixel of the displayed image respectively.

8. The display apparatus of claim 7, wherein the $X_{RedMaxGray\text{-}1}$, the $Y_{RedMaxGray\text{-}1}$ and the $Z_{RedMaxGray\text{-}1}$ have the same values as the $X_{RedMaxGray}$, the $Y_{RedMaxGray}$ and the $Z_{RedMaxGray}$ respectively, and the $X_{GreenMaxGray\text{-}1}$, the $Y_{GreenMaxGray\text{-}1}$ and the $Z_{GreenMaxGray\text{-}1}$ have the same values as the $X_{GreenMaxGray}$, the $Y_{GreenMaxGray}$ and the $Z_{GreenMaxGray}$ respectively, and the $X_{BlueMaxGray\text{-}1}$, the $Y_{BlueMaxGray\text{-}1}$ and the $Z_{BlueMaxGray\text{-}1}$ have the same values as the $X_{BlueMaxGray}$, the $Y_{BlueMaxGray}$ and the $Z_{BlueMaxGray}$ respectively.

9. The method of claim 7, wherein a ratio of X:Y:Z of measured values of the displayed image is equal to a ratio of X:Y:Z of the red pixel, the green pixel and the blue pixel.

10. A method of correcting grayscale data, the method comprising:

measuring a tristimulus value of X, Y and Z values of a displayed image;

generating a target curve with respect to the tristimulus value of X, Y and Z values of the displayed image;

calculating target grayscale values of a red pixel, a green pixel and a blue pixel using the X, Y and Z values of the target curve;

calculating a variation of the red pixel, the green pixel and the blue pixel using the target grayscale values of the red pixel, the green pixel and the blue pixel; and applying the variation of the red pixel, the green pixel and the blue pixel to a grayscale value corresponding to the displayed image to generate a corrected grayscale data, wherein the target grayscale values of the red pixel, the green pixel and the blue pixel are defined by the following Equations:

$$\text{Red}_{Target\ Gray} = \text{Max Gray} \times G_{Red\ target}^{\frac{1}{Red\ Gamma}}$$

$$\text{Green}_{Target\ Gray} = \text{Max Gray} \times G_{Green\ target}^{\frac{1}{Green\ Gamma}}$$

$$\text{Blue}_{Target\ Gray} = \text{Max Gray} \times G_{Blue\ target}^{\frac{1}{Blue\ Gamma}}$$

wherein the $\text{Red}_{Target\ Gray}$ is a red target grayscale value, the $\text{Green}_{Target\ Gray}$ is a green target grayscale value, the $\text{Blue}_{Target\ Gray}$ is a blue target grayscale value and the MaxGray is a maximum grayscale value in a pixel, and wherein the $G_{Redtarget}$, the $G_{Greentarget}$ and the $G_{Bluetarget}$ are defined by the following Equation:

$$\begin{pmatrix} G_{Red\ target} \\ G_{Green\ target} \\ G_{Bluetarget} \end{pmatrix} = \begin{pmatrix} X_{Red\ Max\ Gray-1} & X_{GreenMax\ Gray-1} & X_{BlueMax\ Gray-1} \\ Y_{Red\ Max\ Gray-1} & Y_{GreenMax\ Gray-1} & Y_{BlueMax\ Gray-1} \\ Z_{Red\ Max\ Gray-1} & Z_{GreenMax\ Gray-1} & Z_{BlueMax\ Gray-1} \end{pmatrix}^{-1} \begin{pmatrix} X_{target} \\ Y_{target} \\ Z_{target} \end{pmatrix}$$

wherein the $X_{target}$, the $Y_{target}$ and the $Z_{target}$ are X, Y and Z values of the target curve respectively, and wherein the Red Gamma, the Green Gamma and the Blue Gamma are defined by the following Equations:

$$\text{Red Gamma} = \frac{\log\left(\frac{Y_{Red}}{Y_{Red\ Max\ Gray}}\right)}{\log\left(\frac{\text{Red}_{Gray}}{\text{Max Gray}}\right)}$$

$$\text{Green Gamma} = \frac{\log\left(\frac{Y_{Green}}{Y_{GreenMax\ Gray}}\right)}{\log\left(\frac{\text{Green}_{Gray}}{\text{Max Gray}}\right)}$$

$$\text{Blue Gamma} = \frac{\log\left(\frac{Y_{Blue}}{Y_{BlueMax\ Gray}}\right)}{\log\left(\frac{\text{Blue}_{Gray}}{\text{Max Gray}}\right)}$$

wherein the $Y_{Red\ Max\ Gray}$ is a Y value emitted at a MaxGray of the red pixel, the $Y_{Green\ Max\ Gray}$ is a Y value emitted at a MaxGray of the green pixel, the $Y_{Blue\ Max\ Gray}$ is a Y value emitted at a MaxGray of the blue pixel, the $Y_{Red}$, the $Y_{Green}$ and the $Y_{Blue}$ are Y values at the red pixel, the green pixel and the blue pixel of the displayed image respectively and the $\text{Red}_{Gray}$, the $\text{Green}_{Gray}$ and the $\text{Blue}_{Gray}$ are grayscale values at the red pixel, the green pixel and the blue pixel of the displayed image respectively.

11. The display apparatus of claim 10, wherein the $X_{RedMaxGray\text{-}1}$, the $Y_{RedMaxGray\text{-}1}$ and the $Z_{RedMaxGray\text{-}1}$ have the same values as the $X_{RedMaxGray}$, the $Y_{RedMaxGray}$ and the $Z_{RedMaxGray}$ respectively, the $X_{GreenMaxGray\text{-}1}$, the $Y_{GreenMaxGray\text{-}1}$ and the $Z_{GreenMaxGray\text{-}1}$ have the same values as the $X_{GreenMaxGray}$, the $Y_{GreenMaxGray}$ and the $Z_{GreenMaxGray}$ respectively, and the $X_{BlueMaxGray\text{-}1}$, the $Y_{BlueMaxGray\text{-}1}$ and the $Z_{BlueMaxGray\text{-}1}$ have the same values as the $X_{BlueMaxGray}$, the $Y_{BlueMaxGray}$ and the $Z_{BlueMaxGray}$ respectively.

12. The method of claim 11, wherein a ratio of X:Y:Z of measured values of the displayed image is equal to a ratio of X:Y:Z of the red pixel, the green pixel and the blue pixel.

* * * * *